US007926181B2

(12) United States Patent
Li et al.

(10) Patent No.: US 7,926,181 B2
(45) Date of Patent: Apr. 19, 2011

(54) METHOD FOR MAKING A REINFORCEMENT DEVICE FOR A CONCRETE STRUCTURAL MEMBER, AND METHOD FOR STRENGTHENING THE CONCRETE STRUCTURAL MEMBER

(75) Inventors: Yeou-Fong Li, Taipei (TW); Yan-Jie Lin, Taipei (TW); Hsi-Hsun Chen, Taipei Hsien (TW)

(73) Assignee: National Taipei University of Technology (TW)

( * ) Notice: Subject to any disclaimer, the term of this patent is extended or adjusted under 35 U.S.C. 154(b) by 73 days.

(21) Appl. No.: 12/414,197

(22) Filed: Mar. 30, 2009

(65) Prior Publication Data

US 2009/0183369 A1 Jul. 23, 2009

Related U.S. Application Data

(62) Division of application No. 11/091,998, filed on Mar. 29, 2005, now Pat. No. 7,533,509.

(30) Foreign Application Priority Data

Mar. 30, 2004 (TW) ..... 93108700 A

(51) Int. Cl.
*E04H 12/00* (2006.01)

(52) U.S. Cl. ..... 29/897.34; 52/235.9; 52/236.8

(58) Field of Classification Search ..... 29/897.34; 52/251, 649.2, 649.3, 649.4, 649.1, 236.9, 52/236.8, 236.5, 253, 260, 334
See application file for complete search history.

(56) References Cited

U.S. PATENT DOCUMENTS

| | | | | |
|---|---|---|---|---|
| 1,571,799 | A | 2/1926 | Reeves | 52/649.3 |
| 2,451,777 | A | 10/1948 | Salas | 425/123 |
| 3,200,488 | A * | 8/1965 | Alfred | 29/453 |
| 4,096,680 | A | 6/1978 | Ritter et al. | 52/665 |
| 4,452,028 | A | 6/1984 | Norton et al. | 52/742.14 |
| 4,563,852 | A | 1/1986 | Achtenberg et al. | 52/742.14 |
| 4,831,699 | A * | 5/1989 | Rozzi | 29/897.3 |
| 5,193,324 | A | 3/1993 | Fellows | 52/742.14 |
| 5,392,580 | A * | 2/1995 | Baumann | 52/660 |
| 5,580,642 | A | 12/1996 | Okamoto et al. | 428/212 |
| 5,727,357 | A | 3/1998 | Arumugasaamy et al. | 52/740.1 |
| 5,881,460 | A * | 3/1999 | Nowell et al. | 29/897.34 |
| 6,219,991 | B1 * | 4/2001 | Salek-Nejad | 52/741.3 |
| 6,247,279 | B1 | 6/2001 | Murat et al. | 52/223.3 |
| 2004/0154263 | A1 * | 8/2004 | Li et al. | 52/720.1 |
| 2006/0059841 | A1 * | 3/2006 | Bennett et al. | 52/649.1 |

FOREIGN PATENT DOCUMENTS

| | | | |
|---|---|---|---|
| JP | 06050006 | A | 2/1994 |
| KR | 2006083783 | A | 7/2006 |

* cited by examiner

*Primary Examiner* — David P Bryant
*Assistant Examiner* — Christopher Besler
(74) *Attorney, Agent, or Firm* — Ostrolenk Faber LLP

(57) ABSTRACT

A method for making a reinforcement device for a concrete structure includes the steps of (a) installing a plurality of parallel reinforcement rebars, and (b) embracing the reinforcement rebars with a cable unit by winding the cable unit around the reinforcement rebars. The cable unit has a plurality of wires twisted together.

3 Claims, 7 Drawing Sheets

METHOD FOR MAKING A REINFORCEMENT DEVICE FOR A CONCRETE STRUCTURAL MEMBER, AND METHOD FOR STRENGTHENING THE CONCRETE STRUCTURAL MEMBER

CROSS-REFERENCE TO RELATED APPLICATIONS

The present application is a divisional under 37 C.F.R. §1.53(b) of prior application Ser. No. 11/091,998, filed Mar. 29, 2005, by Yeou-Fong Li et al., entitled METHOD FOR MAKING A REINFORCEMENT DEVICE FOR A CONCRETE STRUCTURAL MEMBER, AND METHOD FOR STRENGTHENING THE CONCRETE STRUCTURAL MEMBER, which claims priority of Taiwanese Application No. 093108700, filed Mar. 30, 2004, the contents of which are specifically incorporated herein.

BACKGROUND OF THE INVENTION

1. Field of the Invention

The invention relates to a method for making a reinforcement device, more specifically, to a method for making a reinforcement device for a concrete structural member, such as a beam-column joint. This invention also relates to a method for strengthening the concrete structural member.

2. Description of the Related Art

Conventionally, the confinement effect of a reinforced concrete beam-column joint is achieved by embracing a plurality of spaced apart stirrups around column and beam reinforcement rebars, and embedding the column and beam reinforcement rebars and the stirrups in concrete.

According to an analysis for the beam-column joint, the concrete is liable to crack when the beam-column joint suffers from an external stress, such as earthquakes. The concrete is thus stripped from the beam-column joint, and the stirrups and the column and beam reinforcement rebars are exposed. As the cracked beam-column joint continues to suffer from the earthquakes, the beam-column joint will break down due to insufficient confining strength of the segments of the exposed column and beam reinforcement rebars between two adjacent stirrups. Therefore, it is desirable in the art to strengthen the confinement effect for the column and beam reinforcement rebars to prevent the beam-column joint from failure.

Conventionally, the confinement effect is improved by increasing the number of the stirrups, thus increasing the density of the stirrups for the beam-column joint. However, the higher density of the stirrups causes an increased difficulty in constructing the beam-column joint, which leads to an increase of the time and the cost for constructing the beam-column joint. Furthermore, the applicants are unaware of a fast and easy method to repair and strengthen the damaged beam-column joint currently available in the industry.

SUMMARY OF THE INVENTION

The object of the present invention is to provide a method for making a reinforcement device for a concrete structural member, especially for a concrete beam-column joint, which improves the structural strength of the concrete structural member and is easy to implement.

In the first aspect of this invention, a method for making a reinforcement device for a concrete structural member includes the steps of (a) installing a plurality of parallel reinforcement rebars, and (b) embracing the reinforcement rebars with a cable unit, such as a steel wire cable, by winding the cable unit around the reinforcement rebars. The cable unit has a plurality of wires twisted together.

The second aspect of this invention is a method for strengthening a concrete structural member, which includes a beam, a column, and a joint region of the column and the beam. The method includes the steps of: (a) hollowing the joint region of the concrete structural member to expose vertical and horizontal reinforcement rebars embedded in the joint region; (b) winding a cable unit around the exposed vertical reinforcement rebars or the exposed horizontal reinforcement rebars; and (c) filling the joint region with concrete to embed the column and beam reinforcement rebars and the cable unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
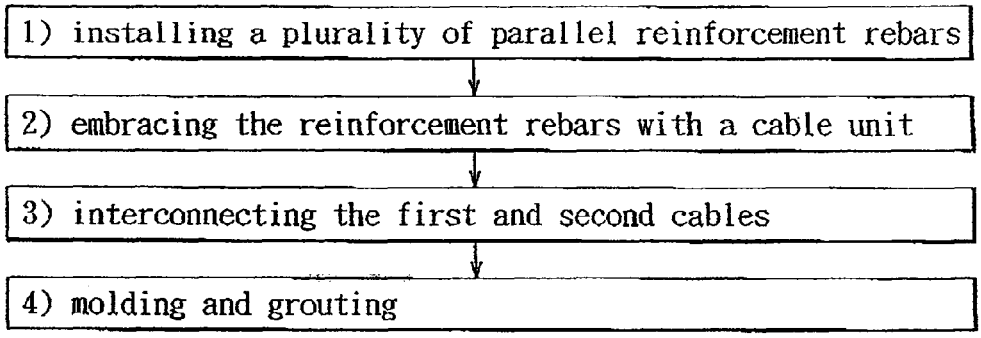
FIG. 1 is a flowchart of the first preferred embodiment of the method for making a reinforcement device for a concrete structural member according to this invention.

Before the present invention is described in greater detail, it should be noted that like elements are denoted by the same reference numerals throughout the disclosure.

Figure 2:
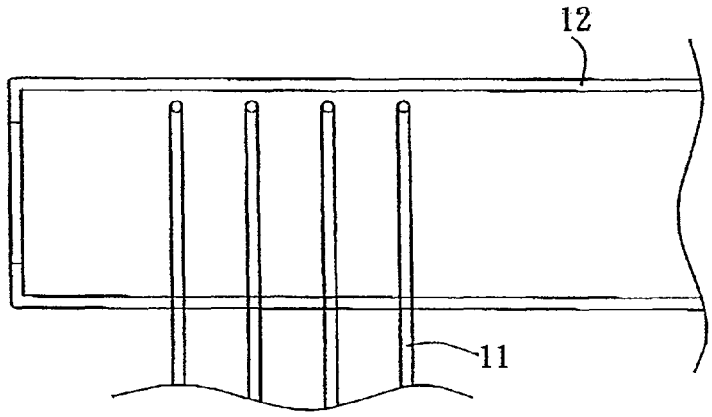
FIGS. 2, 3, 4, and 5 are fragmentary schematic views showing consecutive steps of the first preferred embodiment.

Referring to FIGS. 1, 2, 3, 4, 5, 8, 9, and 10, the first preferred embodiment of the method for making a reinforcement device 1 for a concrete structural member 2 according to this invention includes the steps of:

1) Installing a Plurality of Parallel Reinforcement Rebars 11,12:

Referring to FIG. 2, the reinforcement rebars 11,12 include a plurality of substantially vertical reinforcement rebars 11, and a plurality of substantially horizontal reinforcement rebars 12 intersecting the vertical reinforcement rebars 11

Figure 3:
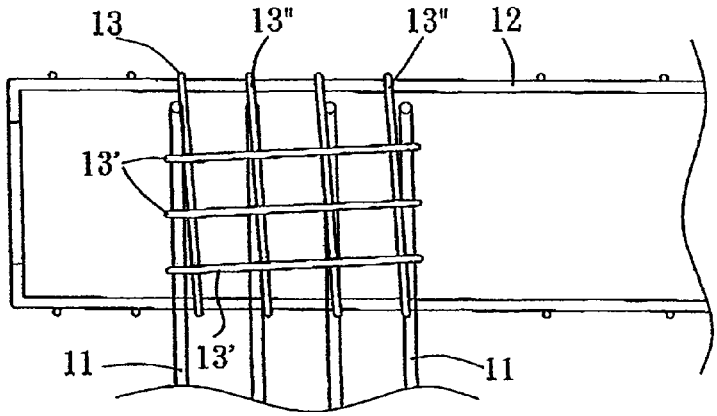
Figure 7:
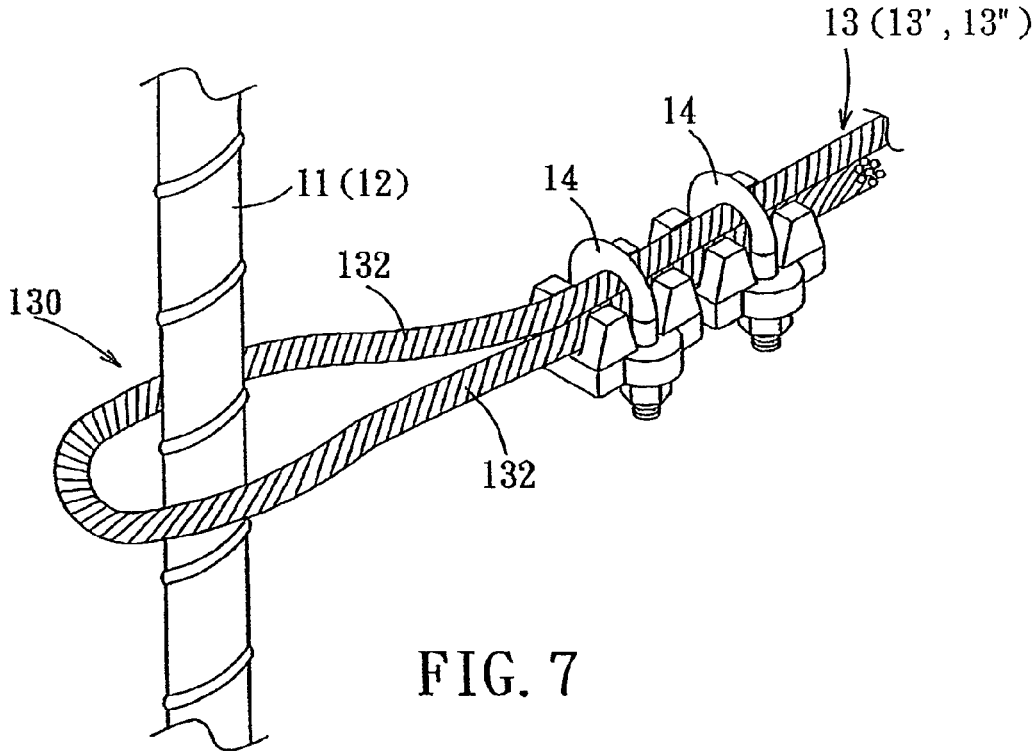
FIG. 7 is a fragmentary perspective view showing how the cable is fastened to a reinforcement rebar in the first preferred embodiment.

2) Embracing the Reinforcement Rebars 11,12 with a Cable Unit 13:

Referring to FIGS. 3 and 7, the vertical and horizontal reinforcement rebars 11,12 are embraced by the cable unit 13. The cable unit 13 has a plurality of wires twisted together. In this preferred embodiment, the cable unit 13 includes a plurality of first set of cables 13' and a plurality of second set of cables 13". The vertical reinforcement rebars 11 are embraced with the first set of cables 13', and the horizontal reinforcement rebars 12 are embraced with the second set of cables 13". Specifically, the vertical reinforcement rebars 11 are embraced by winding each of the first set of cables 13' around all of the vertical reinforcement rebars 11 in a single loop and by respectively fastening two end portions 130 of each of the first set of cables 13' to at least one of the vertical reinforcement rebars 11. That is to say, the two end portions 130 of each of the first set of cables 13' can be fastened to the same vertical reinforcement rebar 11 or to two different vertical reinforcement rebars 11. The horizontal reinforcement rebars 12 are embraced by winding each of the second set of cables 13" around all of the horizontal reinforcement rebars 12 in a single loop and by respectively fastening two end portions 130 of each of the second set of cables 13" to at least one horizontal reinforcement rebar 12. That is to say, the two end portions 130 of each of the second set of cables 13" can be fastened to the same horizontal reinforcement rebar 12 or to two different horizontal reinforcement rebars 12.

Figure 5:
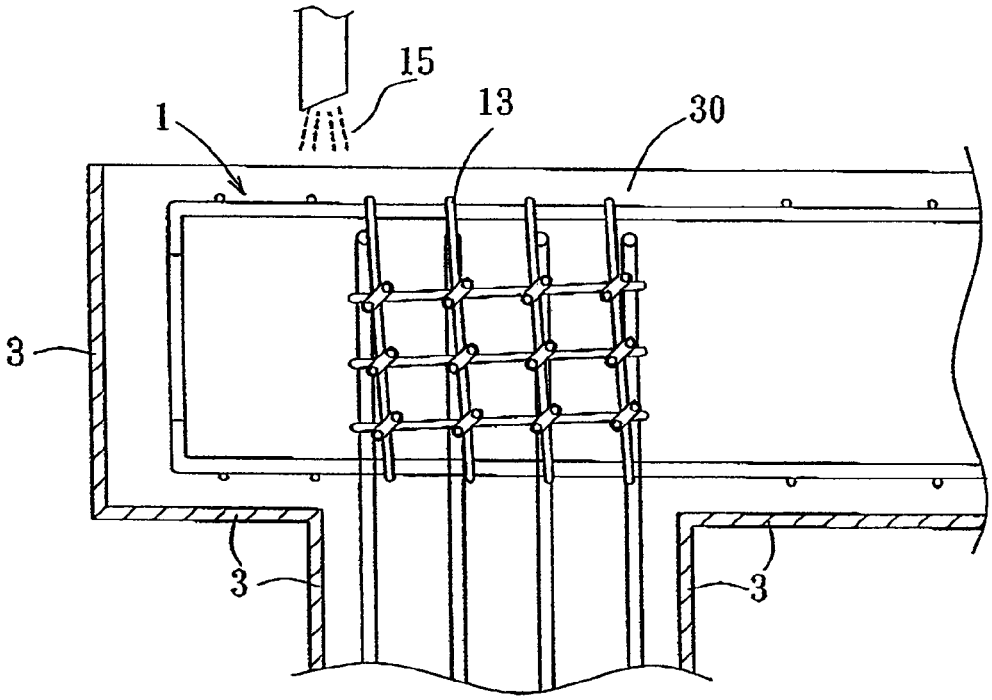

Referring to FIG. 5, each of the two end portions 130 of each of the first set of cables 13' is preferably bent about one of the vertical reinforcement rebars 11 so that the bent end portion 130 forms two parts 132 which sandwich the corresponding vertical reinforcement rod 11 by clamping and fixing the two parts 132 together. The two parts 132 are clamped using at least one cable clamp 14 which has a passage. The two parts 132 are inserted through the passage. The cable clamp 14 is slid over the two parts 132 toward the corresponding vertical reinforcement rebar 11, and is tightened to fix the two parts 132. The two end portions 130 of each of the second set of cables 13" can be fastened to the same horizontal reinforcement rod 12 or to two different horizontal reinforcement rods 12 in a manner similar to that described above. It should be noted that the number of the cable clamps 14 used for clamping and fixing the two parts 132 of each of the first and second sets of cables 13',13" as well as the configuration of the cable clamp 14 can be varied by skilled artisans according to the specific requirements during the practice of this invention. In this preferred embodiment, the vertical reinforcement rebars 11 are embraced by winding each of the first set of cables 13' around all of the vertical reinforcement rebars 11 in a single loop, and the horizontal reinforcement rebars 12 are embraced by winding each of the second set of cables 13" around all of the horizontal reinforcement rebars 12 in a single loop. It should be noted that each of the first set of cables 13' can form a plurality of loops extending helically around the vertical reinforcement rebars 11, and that each of the second set of cables 13" can form a plurality of loops extending helically around the horizontal reinforcement rebars 12.

Figure 4:
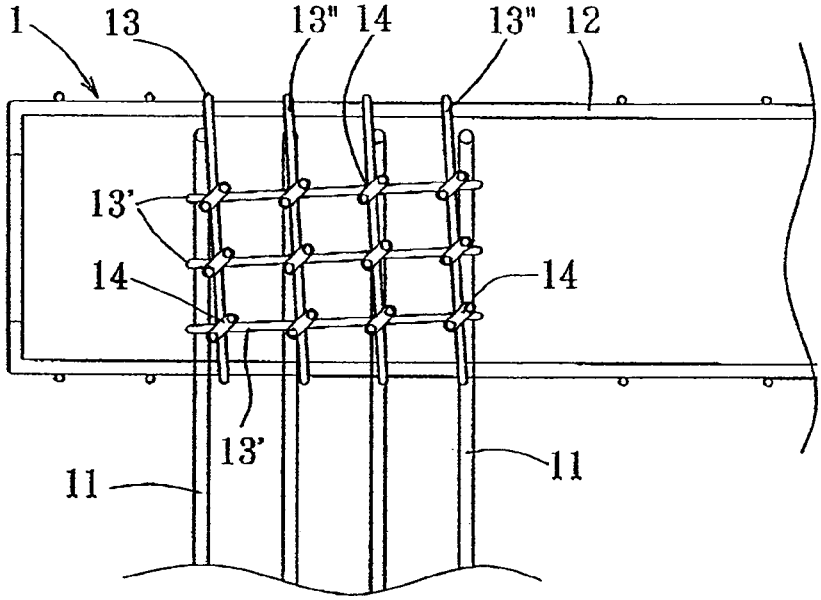

3) Interconnecting the First and Second Set of Cables 13', 13":

Referring to FIG. 4, each of the first set of cables 13' intersects all of the second set of cables 13", and each of the second set of cables 13" intersects all of the first set of cables 13' The first and second sets of cables 13",13" are then interconnected at intersection points thereof using the cable clamps 14. Specifically, each of the first set of cables 13' is connected to one of the second set of cables 13" using one of the cable clamps 14. The cable clamp 14 includes a passage to receive and clamp each of the first set of cables 13' and a corresponding one of the second set of cables 13" to enhance the positioning effect of the first and second sets of cables 13',13". Therefore, the confinement effect of the reinforcement device 1 may not be substantially and adversely affect when one or more of the first and second cables 13',13" break.

4) Molding and Grouting:

Referring to FIG. 5, a mold 3 is made to surround the reinforcement device 1 and to define a filling space 30. Concrete 15 is then grouted into the filling space 30 of the mold 3 to embed the reinforcement device 1. After the concrete 15 solidifies, the mold 3 is removed to obtain the concrete structural member 2.

Figure 8:
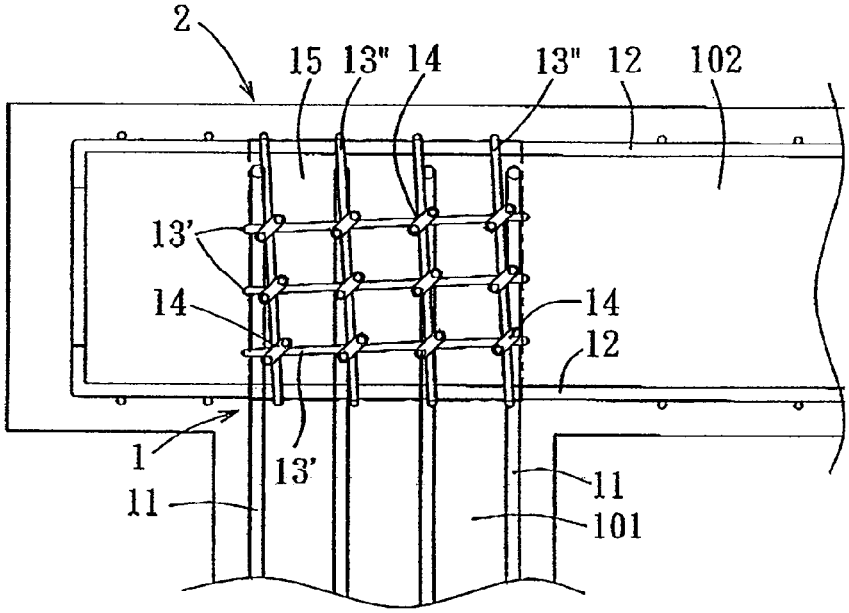
FIGS. 8, 9, and 10 are fragmentary schematic views showing the concrete structural member including the reinforcement device made by the first preferred embodiment.
Figure 9:
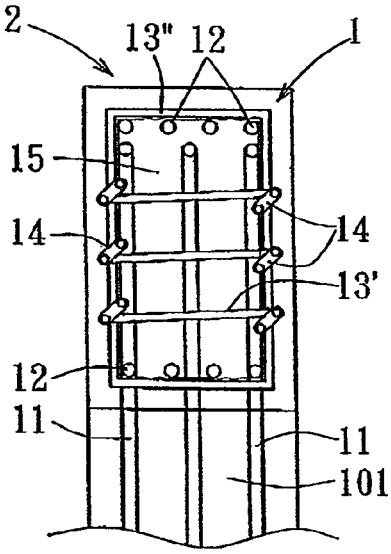
Figure 10:
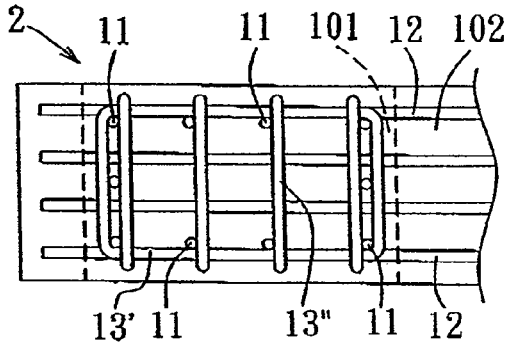

Referring to FIGS. 8, 9, and 10, the concrete structural member 2 made by the preferred embodiment of the present method is abeam-column joint. It includes a plurality of the vertical reinforcement rebars 11, the horizontal reinforcement rebars 12 intersecting the vertical reinforcement rebars 11, a plurality of the first set of cables 13' embracing the vertical reinforcement rebars 11, a plurality of the second set of cables 13" embracing the horizontal reinforcement rebars 12, a plurality of cable clamps 14 fixing end portions of each of the first and second sets of cables 13',13" and interconnecting the first and second sets of cables 13',13" at intersection points thereof, and the concrete 15 embedding the reinforcement device 1.

Ten vertical reinforcement rebars 11 and eight horizontal reinforcement rebars 12 are used in this preferred embodiment. A beam 102 and a column 101 extend from the concrete structure 2 (i.e., the beam-column joint), and each of the beam 102 and the column 101 has a 50 cm×30 cm cross-section area. It should be noted that the number, the size, the material for the vertical and horizontal reinforcement rebars 11, 12, and the configuration of the cable clamp 14 can be varied according to the specific requirements during the practice of this invention.

Figure 6:
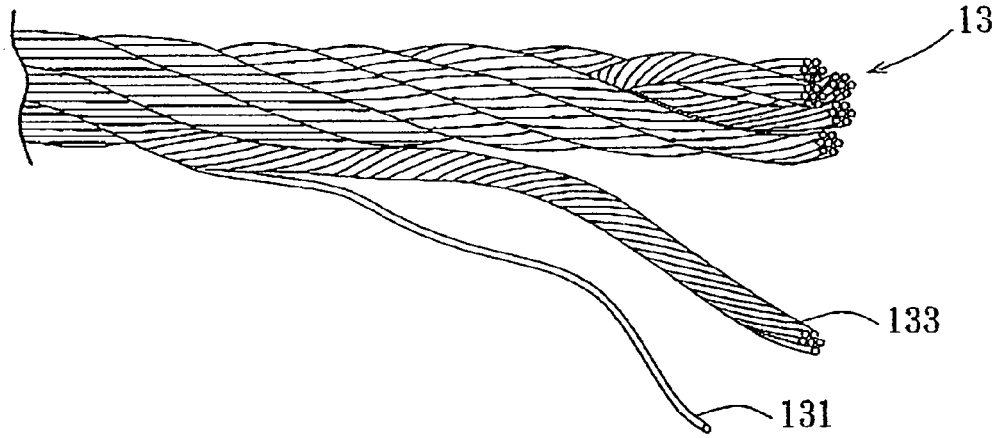
FIG. 6 is a fragmentary perspective view of a cable used in the first preferred embodiment.

Referring to FIG. 6, the cable unit 13 used in this preferred embodiment is made by inter-twisting a plurality of metal wires 131 to form a metal strand 133, and by inter-twisting a plurality of the metal strands 133 to form the cable unit 13. The cable unit 13 used in the preferred embodiment has a diameter of 6 mm, and an elastic modulus of $3.9\times10^5$ kgf/cm$^2$. The size and the material for the cable unit 13 can be varied according to the specific requirements during the practice of this invention.

Referring to FIGS. 8, 9, and 10, the spacing between two adjacent first cables 13', 13" or between two adjacent second cables 13" is 5 cm, which can be varied according to the specific conditions. The first and second cables 13',13", after being wound, lie in a plane which is oblique to the vertical and horizontal reinforcement rebars 11,12.

Figure 11:
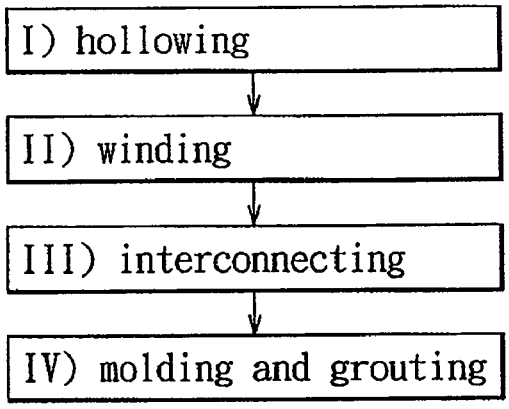
FIG. 11 is a flowchart of the second preferred embodiment of the method for strengthening a concrete structural member according to this invention.
Figure 12:
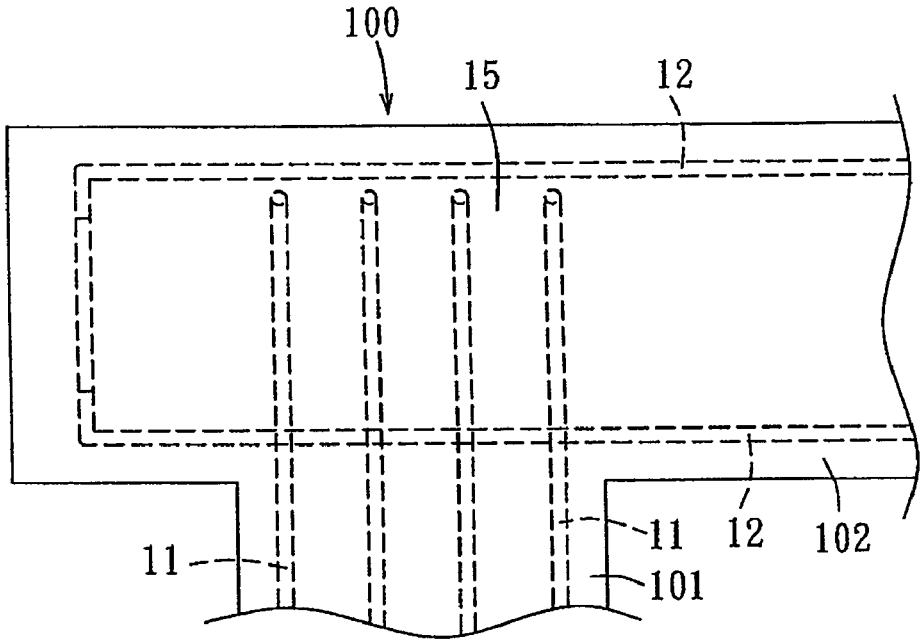
FIGS. 12, 13, 14, 15, and 16 are fragmentary schematic views showing consecutive steps of the second preferred embodiment.
Figure 13:
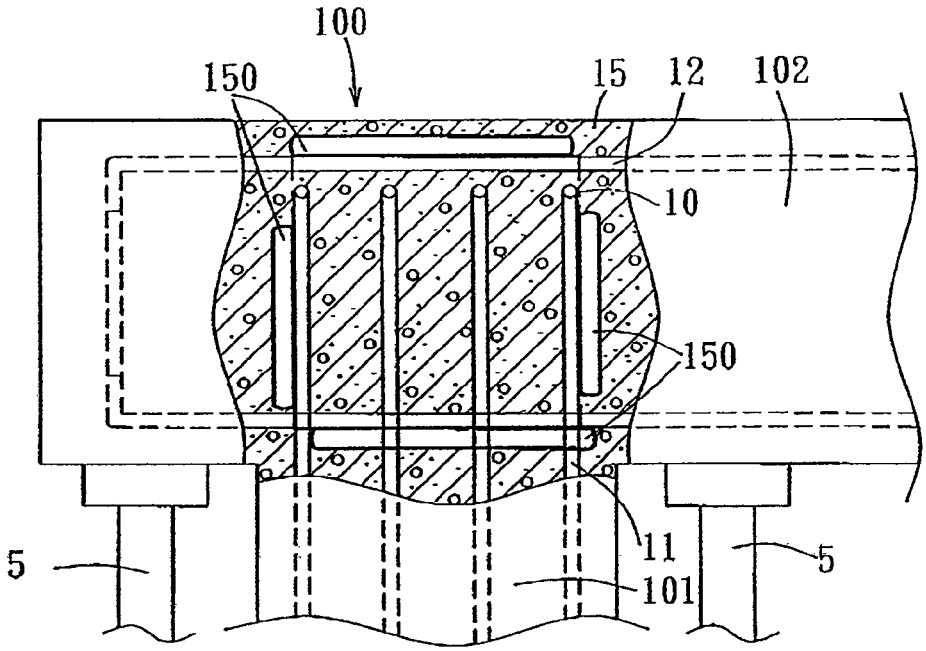

Referring to FIG. 11, the second preferred embodiment of this invention is directed to a method for strengthening an existing concrete structural member 100, which includes a joint region 10 of a column 101 and a beam 102. Referring to FIG. 12, the concrete structural member 100 further includes a plurality of vertical reinforcement rebars 11, a plurality of horizontal reinforcement rebars 12 intersecting the vertical reinforcement rebars 11, and concrete 15 embedding the vertical and horizontal reinforcement rebars 11,12. The preferred embodiment of the method for strengthening the concrete structural member 100 includes the steps of:

I) Hollowing:

Referring to FIG. 13, the joint region 10 of the concrete structural member 100 is hollowed by removing a part of the concrete 15 to expose the vertical and horizontal reinforcement rebars 11, 12 embedded in the joint region 10. In practice, supporting members 5 are mounted adjacent to the column 101 to support the beam 102 before removing the concrete structural member 100 to prevent the concrete structural member 100 from collapsing during the subsequent processing. A plurality of through holes 150 are formed to define the joint region 10.

Figure 14:
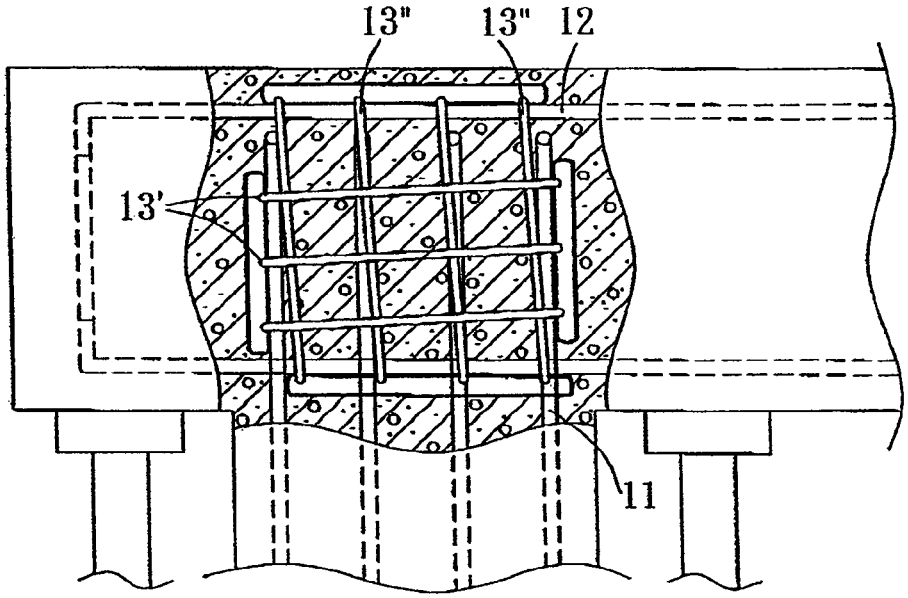

II) Winding:

Referring to FIG. 14, the exposed vertical reinforcement rebars 11 are wound and embraced by a plurality of the first set of cables 13', and the exposed horizontal reinforcement rebars 12 are wound and embraced by a plurality of the second set of cables 13". The details for conducting this step are similar to the step 2) of the first preferred embodiment.

Figure 15:
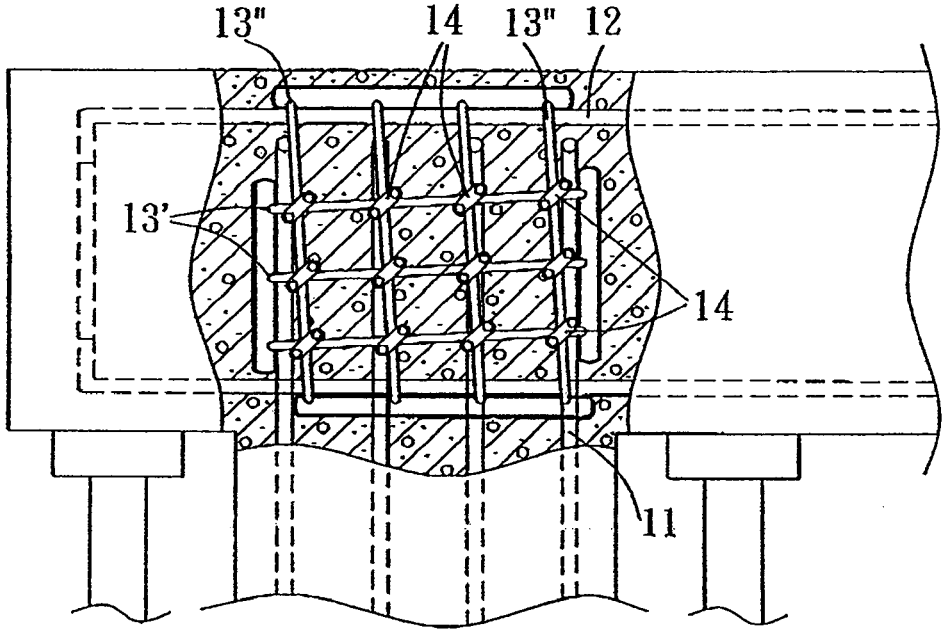

III) Interconnecting:

Referring to FIG. 15, the first and second cables 13', 13" are interconnected at intersection points thereof by using the cable clamps 14. The details for conducting this step are similar to the step 3) of the first preferred embodiment.

Figure 16:
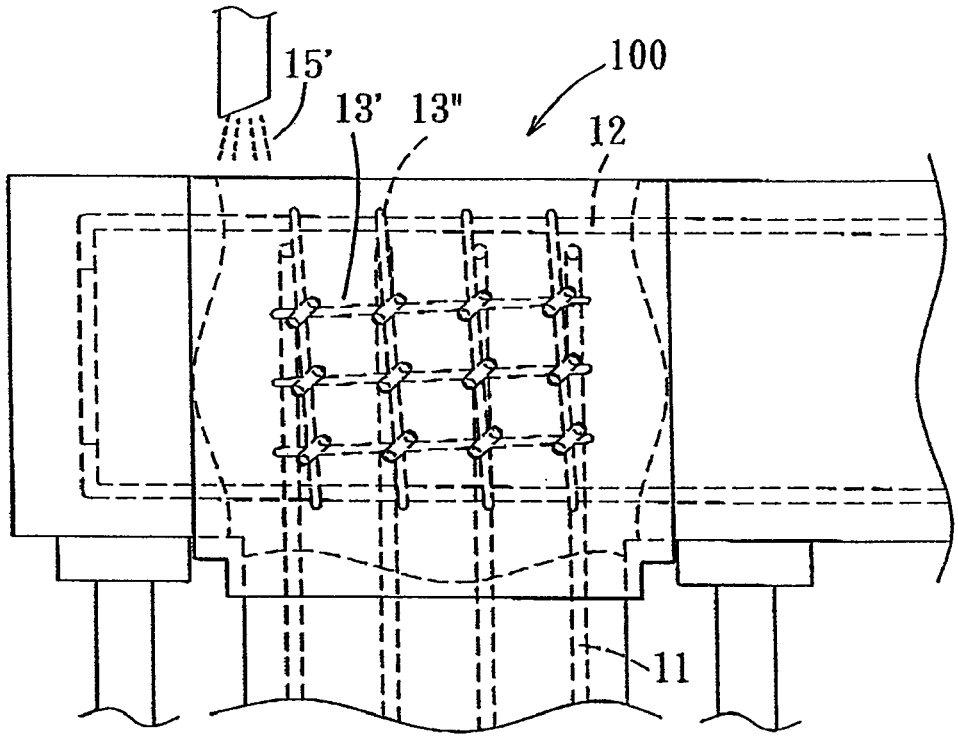

IV) Molding and Grouting:

Referring to FIG. 16, the joint region 10 is grouted with fresh concrete 15' to embed the column and beam reinforcement rebars 11,12, the first and second sets of cables 13',13", and the cable clamps 14 to reconstruct and strengthen the concrete structural member 100.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A method for making a reinforcement device for a concrete structural member, comprising the steps of:

(a) installing a plurality of reinforcement rebars; and (b) embracing the reinforcement rebars with a cable unit by winding the cable unit around the reinforcement rebars, the cable unit including a plurality of wires twisted together, wherein said reinforcement rebars include a plurality of vertical reinforcement rebars and horizontal reinforcement rebars which intersect the vertical reinforcement rebars, the cable unit including a plurality of a first set of cables and a second set of cables, wherein step (b) includes embracing the vertical reinforcement rebars with the first set of cables, and embracing the horizontal reinforcement rebars with the second set of cables, and wherein each of the first set of cables intersects all of the second set of cables and each of the second set of cables intersects all of the first set of cables, the method further comprising interconnecting the first and second sets of cables at intersection points thereof.

2. The method of claim 1, wherein the vertical reinforcement rebars are embraced by winding each of the first set of cables around all of the vertical reinforcement rebars and by respectively fastening two end portions of each of the first set of cables to at least one of the vertical reinforcement rebars, and wherein the horizontal reinforcement rebars are embraced by winding each of the second set of cables around all of the horizontal reinforcement rebars and by respectively fastening two end portions of each of the second set of cables to at least one of the horizontal reinforcement rebars.

3. The method of claim 1, wherein each of the first set of cables is connected to one of the second set of cables using a cable clamp which includes a passage to receive and clamp each of the first set of cables and a corresponding one of the second set of cables.

* * * * *